United States Patent [19]

Brandeau

[11] Patent Number: 4,524,510

[45] Date of Patent: Jun. 25, 1985

[54] METHOD OF MAKING WIRE TERMINATIONS

[75] Inventor: Edward P. Brandeau, Martinsville, N.J.

[73] Assignee: Thomas & Betts Corporation, Raritan, N.J.

[21] Appl. No.: 447,592

[22] Filed: Dec. 7, 1982

[51] Int. Cl.[3] ..... H01R 43/04

[52] U.S. Cl. ..... 29/861; 29/566.4; 29/749; 29/751; 29/753

[58] Field of Search ..... 29/861, 866, 749, 750, 29/751, 753, 758, 566.4, 566.3; 339/97 R, 97 P, 98, 99 R

[56] References Cited

U.S. PATENT DOCUMENTS

| | | | |
|---|---|---|---|
| 3,027,536 | 3/1962 | Pasternak | 339/97 |
| 3,147,058 | 9/1964 | Zdanis | 339/97 R |
| 3,277,347 | 10/1966 | Ecker | 317/101 |
| 3,646,572 | 2/1972 | Burr | 174/68.5 |
| 3,668,301 | 6/1972 | Faulconer | 174/88 R |
| 3,866,294 | 2/1975 | McCaughey | 29/566.4 |
| 3,872,236 | 3/1975 | Swengel, Sr. et al. | 174/68.5 |
| 3,997,956 | 12/1976 | McKee | 29/749 X |
| 4,129,349 | 12/1978 | von Roesgen | 339/17 |
| 4,168,873 | 9/1979 | Luna | 339/97 R |
| 4,173,388 | 11/1979 | Brandeau | 339/276 |
| 4,412,374 | 11/1983 | Forberg et al. | 29/751 X |

FOREIGN PATENT DOCUMENTS

| | | | |
|---|---|---|---|
| 2437399 | 2/1976 | Fed. Rep. of Germany | 339/97 R |

OTHER PUBLICATIONS

Electronic Connector Study Group Inc., Fourteenth Annual Connectors and Interconnections Symposium Proceedings, "Quick Connect-A Circuit Pack Bread Boarding Technique"-Lubowe and Wu, pp. 187-198, Nov. 11-12, 1981.

Electronic Connector Study Group Inc., Fourteenth Annual Connectors and Interconnections Symposium Proceedings, "Quick Connect-A Point-to-Point Wiring System", Fleming, pp. 199-202, Nov. 11-12, 1981.

*Primary Examiner*—Carl E. Hall

*Attorney, Agent, or Firm*—Robert M. Rodrick; Salvatore J. Abbruzzese

[57] ABSTRACT

In interconnecting an electrical wire to a conductive terminal having wire receiving slots therein arranged in intersecting disposition, the wire is indexed to the tool and then to the terminal. The wire is located into the slots, without making connection thereto, by applying a light force transversely thereto by a wire pushing element. The connection is made by forcibly inserting the wires into the slots by the pushing element that is configured with a plurality of intersecting splines or vanes to engage the wires and enter the slots within their boundaries during insertion. Such entering of the slots by the splines on the pushing element provides a uniform force application and a full seating of the wires deeply into the slots along a wire length greater than its diameter such that the wires are deformed and wedged tightly in the bottom of the slots.

6 Claims, 10 Drawing Figures

METHOD OF MAKING WIRE TERMINATIONS

CROSS-REFERENCE TO RELATED APPLICATION

This application is related to U.S. patent application, Ser. No. 447,591, entitled "Wire Termination System and Terminator Therefor", filed on even data herewith and commonly assigned to the same assignee as is the present application.

FIELD OF THE INVENTION

This invention relates generally to an electric wire termination system and assembly and more particularly to a method for making wire terminations.

BACKGROUND OF THE INVENTION

There are several known ways for discrete point-to-point wiring of components on printed circuit boards, backpanels or the like. By far the most common is the wire-wrap system. In this approach, a terminal, including either a socket or input/output (I/O) pin and a post, is fitted into a printed circuit board to form wiring points with the post projecting therefrom. An insulated wire is cut to length and each wire end is stripped of insulation exposing the conductor which is then wrapped around the terminal post. More than one level of wires may be wrapped on an individual post. Not only does this technique require considerable time for wrapping, unwrapping or modifying, but the three and four level wraps often require complicated programming and planning. Moreover, in the upper levels of a multi-wire-wrap termination, a problem in electrical impedance matching is encountered at short pulse rise times because of the physical distance the wires are located above the wiring board.

An alternative to the wire-wrap system which is intended as an improvement in providing greater economy of making connections on a wiring board is the "quick-connect" system which utilizes an insulation displacement technique. In this approach, a wire terminal including a socket or pin on one end and an insulation displacing contact portion on the other end, is mounted in a circuit board. The contact portion typically includes a pair of tines spaced by a slot for receiving an insulated wire. Interconnections are made by pushing the insulated wire into the slot such that the insulation is displaced and intimate contact is made directly with the wire conductor. More than one wire may be inserted into each slot and such a terminal may be utilized for both input and output purposes. Such insulation displacement terminals and interconnections are more fully described in two articles published by the Electronic Connector Study Group Inc. at the Fourteenth Annual Connectors and Interconnections Symposium Proceedings, Nov. 11 and 12, 1981, one article by Anthony G. Lubowe and C. Phillip Wu, Bell Telephone Laboratories, Inc., entitled "Quick Connect—A Circuit Pack Breadboarding Technique", pages 187–198, and the other by Don Fleming, Robinson Nugent, Inc., entitled "Quick Connect—A Point-To-Point Wiring System", pages 199–206.

One problem with the above insulation displacement approach is in the integrity of the electrical and mechanical connection, in particular with small diameter wires in the range of 30 gauge or finer. The contact tines are typically thin, of thickness about the diameter of the wire and, as such, the bearing surface on a wire is relatively small, resulting in the wire being insufficiently held for high contact reliability or mechanical strength. Another problem is the critical size of the wire slot which must be precisely maintained relative to wire diameter to provide a gas tight connection to the wire. Smooth transition regions at the slot edges, instead of sharp edges, are difficult to maintain in volume manufacturing and hence, increased cost and poorer performance result. Moreover, the stacking in one slot of multiple wires presents an additional problem in that an upper wire disturbs a lower one with an overall lessening in contact integrity.

Despite the new connection approaches, the wire-wrap system, even with its shortcomings, is still the standard of reliability by which other systems, especially mechanically crimped ones, are presently measured. As such, it is necessary to equal or exceed the electrical and mechanical reliability of wire wrap joints for a different termination system to be acceptable to the performance driven portions of the computer and telecommunication industries. These industries, spurred by the revolution in semiconductor technology and the development of very large scale integrated (VLSI) circuits, have great need for a discrete wiring system which at the same time offers high reliability, improved electrical impedance matching for the high speed signal pulses to and from VLSI circuits, much higher density of wiring, greater system versatility, and, of course, cost effectiveness. The present invention is intended to fill this need for an improved method of wire termination in a wiring system.

Those who have worked in the art of terminating fine wires, especially fine insulated wires in ranges from 30 gauge (10 mil copper) down to 42 gauge (2.5 mil copper) appreciate the problems involved in making reliable, low-cost terminations where literally billions of joints are involved. Among these problems are the low strength and small size of the wire (in some cases finer than human hair), the difficulty of maintaining dimensional control of very small contacts and, of course, precise control of the steps in terminating the wire. A highly reliable method of terminating fine insulated wire is desirably independent of manufacturing and of human variables. In other words, the wiring system should be inherently self-compensating for minor dimensional differences of wire and contact, for reasonable variations in applicator tooling, for differences in operator skill, and, most importantly, in the initial alignment of wire to contact.

SUMMARY OF THE INVENTION

It is therefore a primary object of the invention to provide an improved method of wire termination which overcomes all or most of the limitations of previous methods.

It is another object of the invention to provide a wire termination method utilizing insulation displacement or removal techniques.

It is a further object of the present invention to provide an improved method of making reliable terminations with fine wires.

In accordance with the invention, a method is disclosed for interconnecting an electrical wire and a terminal having a wire receiving slot therein. In the method, the wire is indexed to the terminal such that the wire is in registry with the slot. The wire is located with the slot and a force is applied within the boundaries of the slot to insert the wire therein to internally engage sidewalls of the slot.

In the preferred form of terminating fine insulated wires on very close centers, a plurality of contact devices are provided, each device having upper faces with a plurality of radially extending wire receiving slots. A wire is indexed relative to the end of a stuffing tool and the tool is indexed laterally on a contact device and vertically thereagainst with the wire lying across the device upper face. The wire is indexed radially relative to a selected slot, the wire being seated in the top of such slot. The wire is forced progressively into the slot deeper near the device center than at the outer edge, such wire being inserted sufficiently deep near the center to skive away the insulation along the sides of the wire conductor. The wire is forceably seated with a portion of the wire insulation being compacted tightly between the bottom of the wire conductor and a bottom wall of the slot, the wire conductor being substantially deformed and wedged tightly in the slot.

DETAILED DESCRIPTION OF THE PREFERRED EMBODIMENTS

Figure 1:
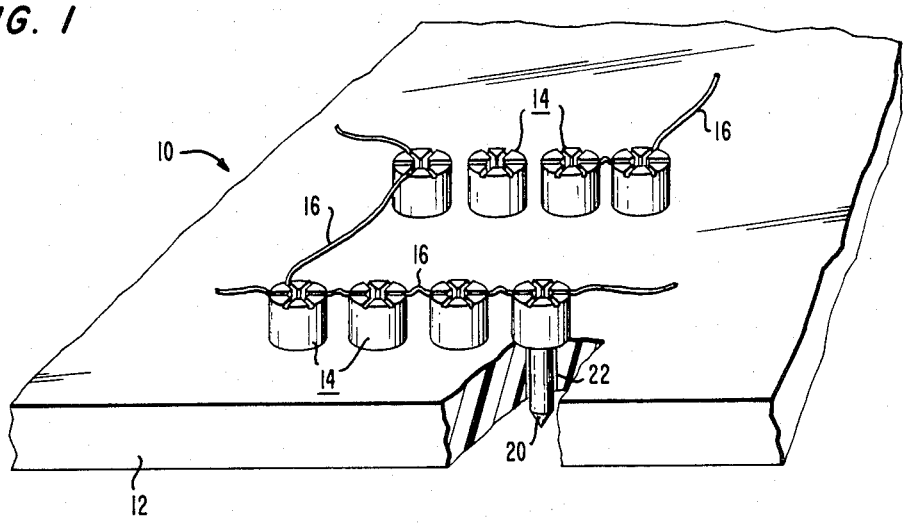
FIG. 1 is a perspective view of a wire termination system made in accordance with the method of the present invention with an insulative board being shown as fragmented and partly broken away to show details thereof.

Referring now to the drawings, there is shown in FIG. 1 a point-to-point, high density wire termination system 10 including an insulative wiring board 12, a plurality of wire terminals 14 and a plurality of wires 16 electrically interconnecting such terminals 14 in a desired pattern. The board 12 may be a fiberglass reinforced plastic or other insulative substrate commonly used in printed circuit boards, backpanels or the like. The board 12 may have suitable conductive traces (not shown) thereon to provide desired component interconnections. Wires 16 are insulated wires, for example, of 30 gauge solid copper conductor but may be of 32 gauge or finer (i.e., smaller diameter). Wires of 26 and 28 gauge (i.e., larger diameter) are also contemplated. Similarly, although insulated wire is used in the termination system, non-insulated wires may also be terminated in accordance with the techniques of the present invention, as set forth in more detail hereinbelow.

Figure 2:
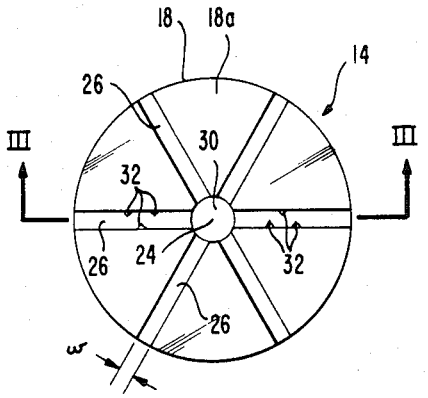
FIG. 2 is an enlarged plan view of a terminal useful in the termination system of FIG. 1.
Figure 3:
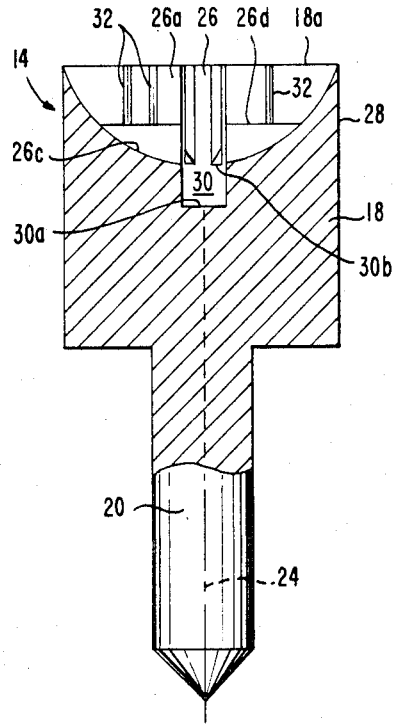
FIG. 3 is a partial sectional view of the terminal of FIG. 2 as seen along viewing lines III—III thereof.

The terminals 14 as seen also in FIGS. 2 and 3 each include an upper cylindrical body 18 having a wire-receiving slotted face 18*a* and a lower integral pin 20 extending axially from the body 18. The pin 20 may be press-fit into an aperture 22 extending through board 12 or may be suitably soldered to conductive traces on the board. Body 18 may also be directly soldered to the board traces without any pin or post portion. Although a solid pin 20 is illustrated, the terminal 14 may also have other termination configurations such as, for example, a socket for receiving component leads.

Referring still to FIGS. 2 and 3, the structural details of the terminal 14 may be more fully understood. In the upper face 18*a* of the cylindrical body 18, which face 18 is substantially orthogonal to the longitudinally extending central axis 24 of the body 18, there are a plurality of radially extending slots 26 formed through the surface 18*a* and into the interior of the body 18. The slots 26 extend into the body along a plane generally parallel with the central axis 24. The slots 26 each preferably extend diametrically across the body 18 through the axis 24 and out through the periphery or outer edge 28 of the body 18. The slots 26 may, however, begin and end at a location interiorly of the periphery 28 without emerging therethrough. The slots 26, as illustrated, intersect at the central portion of the body, are approximately equally spaced angularly thereabout, and have approximately equal widths w (FIG. 2).

Figure 7:
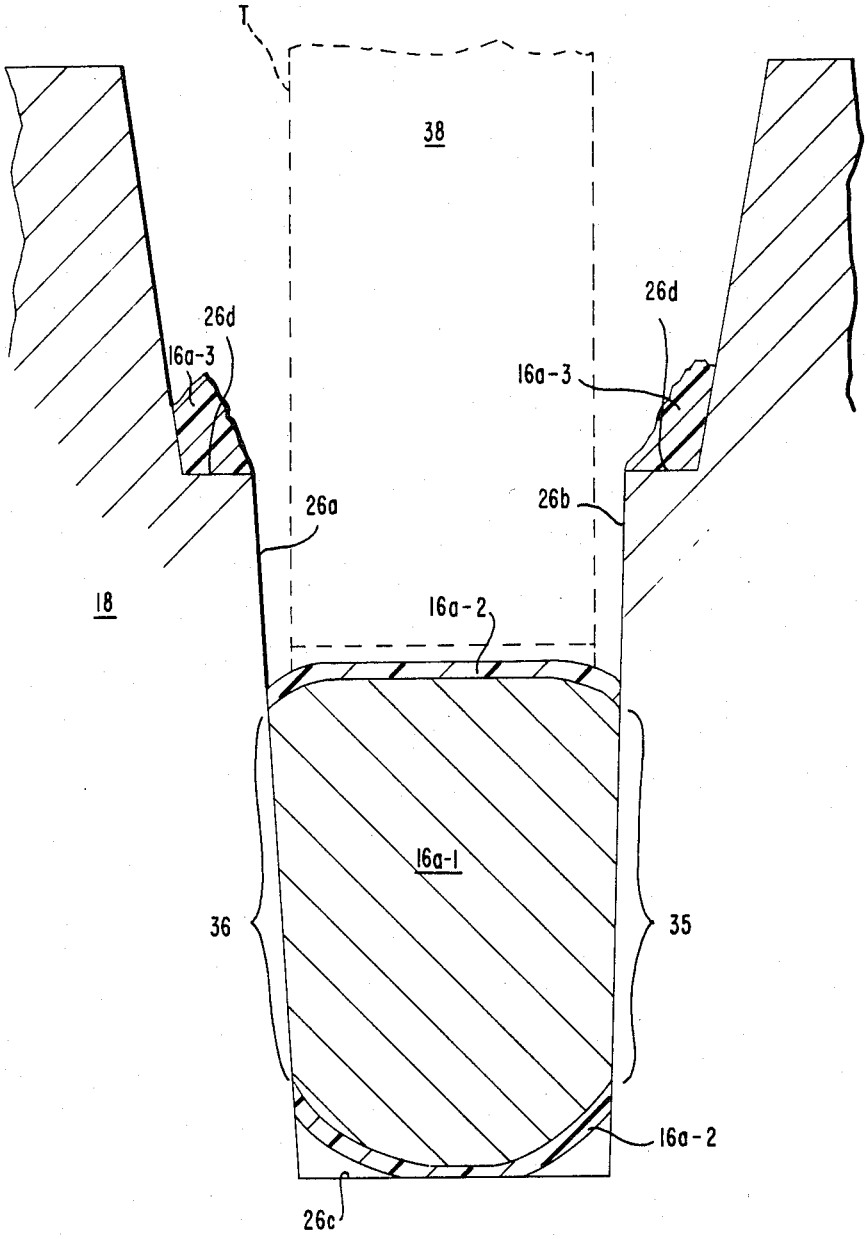
FIG. 7 is a greatly enlarged partial sectional view of FIG. 6 as seen along lines VII—VII thereof.

The width w of each slot 26 is formed to receive a wire therein and at some point along its depth to be in interference relation with such wire. The sidewalls 26*a* and 26*b* of the slot, as shown in FIG. 7, may be slightly tapered outwardly and upwardly to present a wedging action to a wire received therein. Each slot 26 has a bottom wall 26*c* that is non-linear, and preferably curved, and that, as seen in FIG. 3, is deeper as measured from upper surface 18*a* at the body central portion than at its periphery 28. The slots 26, as configured, thereby have a non-uniform depth along their lengths. All the slots 26 are formed approximately to a common depth. At the intersection of the slots 26, a recess or well 30 is formed, the bottom wall 30*a* of which extends deeper from surface 18*a* than the slot bottom wall 26*c*. Each of the slots 26 communicates with the recess 30 at edges 30*b*. As seen in FIGS. 2 and 3, opposing ribs 32, which are staggered as shown, and well inward of outer edge 28, may be formed in an axial direction in one or more of the slot sidewalls. These ribs are a further aid in cutting through wire insulation and in gripping the wire conductor, thereby extending the range of wires capable of being terminated in a terminal 14 and in preventing pullout of a wire from its slot. The terminal 14 as described herein is preferably a copper alloy and may be formed by known manufacturing techniques.

Figure 4:
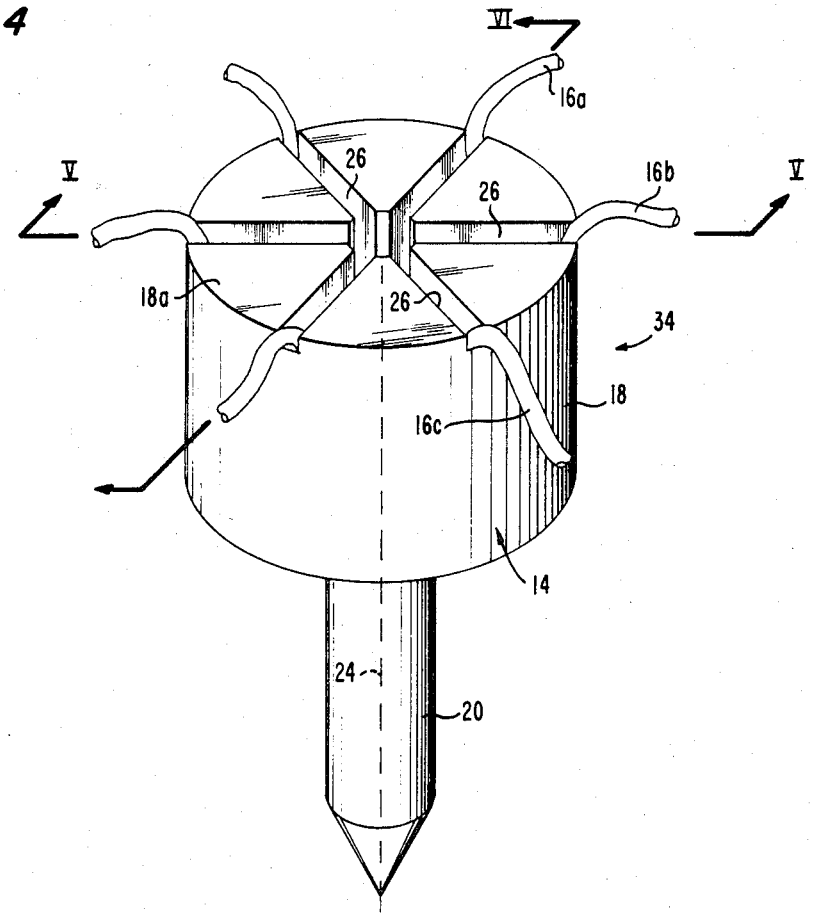
FIG. 4 is a perspective view of a wire termination assembly including the terminal of FIG. 2 and a plurality of wires received in slots therein.
Figure 5:
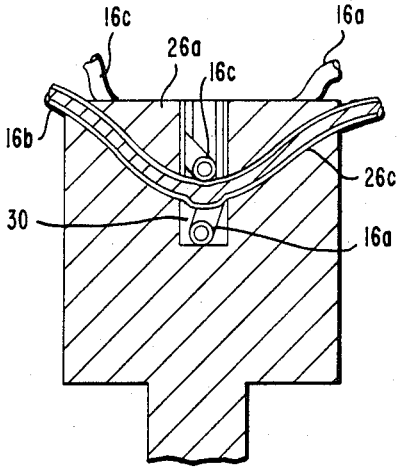
FIGS. 5 and 6 are fragmentary sectional views of the assembly of FIG. 4 as seen along lines V—V and VI—VI, respectively, thereof.
Figure 6:
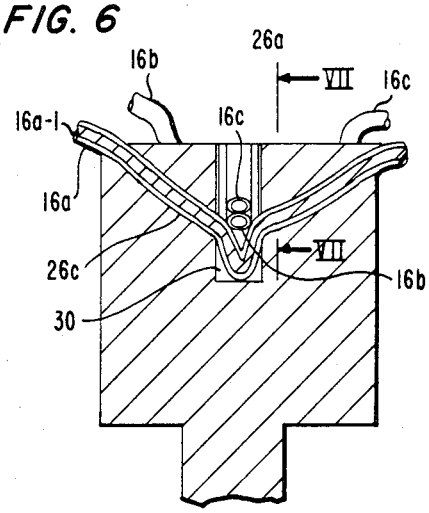

With reference now to FIGS. 4, 5 and 6, the interconnection of wires into assembly with the terminal 14 and the advantages derived therefrom may be appreciated. As depicted in FIG. 4, three insulated wires 16*a*, 16*b* and 16*c* are shown as terminated in terminal 14 forming thereby a wire termination assembly 34. It should be understood that the assembly 34 may also include fewer than three wires (six wire ends). The termination assembly 34 is made by using suitable tooling whereby the individual wires are separately indexed to be in registry with respective slots 26. Once in proper registry with the slot, a wire is then pre-positioned therein by application of a relatively light force whereby suitable location with the slot is effected without connection being made thereto. The wire is then urged forcibly into the slot transversely to the wire axis, preferably with a pushing element on a tool that also enters the slot, so that the desired insulation skiving, wire seating and electrical interconnection, as will be described hereinbelow, are achieved. The introduction of a pushing tool element into the slot, i.e., within the slot boundaries, provides a more uniform force application and assurance of full insertion of the wire into the slot without breakage of the wire. A tool for effecting such interconnection is more fully described in copending, commonly-assigned patent application, Ser. No. 447,593, entitled "Wire Termination Tool", and filed on even date herewith.

The interconnection of the wires 16*a*, 16*b* and 16*c* with the terminal 14 in the assembly 34 is seen in more detail in FIGS. 5 and 6. From the drawings, it can be seen that wire 16*a* has been inserted first, followed by wire 16*b* and then by wire 16*c*. In inserting wire 16*a*, for example, the insulation is forcibly removed from the longitudinal sides of the wire 16*a* by the slot sidewalls 26*a* and 26*b* as by skiving. A good intimate contact is thereby made between the conductive sidewalls 26*a* and 26*b* and the solid conductor 16*a*-1 as shown in FIG. 7. FIG. 7 is drawn in enlarged scale from a photomicrograph of a cross-section (taken as indicated in FIG. 6) of an actual contact and fine gauge "Formvar" insulated wire. It will be noted that wire 16*a* has been greatly deformed from its original circular cross-section by the force of pushing it to the bottom of slot 26. Between the bottom wall 26*c* of the slot and the conductor part 16*a*-1 of the wire, a thin layer of insulation 16*a*-2 remains, and a similar thin layer 16*a*-2 lies on the top of the wire. However, the insulation along zones 35 and 36, which also extend perpendicularly to the plane of the drawing for a considerable distance along the slot length has been skived away and virgin surfaces of bare wire are held in gas tight, high force, clean contact with the connector body 18. To further aid in the skiving of wire insulation as a wire is terminated, a pair of steps or sharp shoulders 26*d* are provided in the walls 26*a* and 26*b* of some or all of the slots 26. Insulation residue 16*a*-3 is left on these shoulders as the wire is pushed to the bottom of the slot 26.

Because the coefficients of thermal expansion of the wire and contact body have been selected to be identical, or nearly so, the contact resistance between wire and connector is substantially unaffected by wide temperature changes. The area of contact between wire and connector is many times the cross-sectional area of the wire further adding to the low and stable contact resistance of this connection.

As mentioned hereinabove, a suitable tool for inserting wires 16 into slots 26 is described and claimed in a commonly-assigned patent application filed on even date with the present application. However, to aid in the understanding of how a wire is crimped or coined into a respective slot 26 of the present invention, there is shown in FIG. 7 a portion of a tool blade 38 of an applicator tool T. It will be seen that the blade 38 of the tool actually enters a slot and forces a wire along its length to the bottom of the slot. The end of the tool is somewhat narrower than the slot and thus can force a wire to the bottom of the slot, being guided by the walls thereof. The wire is thus supported along its length in the slot thereby avoiding tension on the wire which might otherwise easily break it.

Because a slot 26 is much deeper in the center than at the periphery or outer edge 28 of body 18, and because the slot is wider at top, and narrower at bottom, a wire 16 has a high degree of strain relief or mechanical protection against being broken or pulled out from its slot. It will be appreciated by those skilled in the art that fine wires (e.g., 30 gauge or finer) require proper mechanical support to prevent breakage of the wire or loosening of the contact and that this is very difficult to obtain in other prior arrangements. In the present arrangement virtually all of wires 16 when pulled at right angles to the axis 24 of their connector bodies 18, i.e., parallel to the plane of board 12, will break randomly. Such wires 16 did not break deep inside the connector where electrical contact is made, much less be pulled out from the connector.

Referring now to FIG. 6, wire 16*a* is inserted into slot 26 until it bottoms on slot walls 26*c*. In the central portion of the terminal body 18, a portion of the wire 16*a* is further forced downwardly to extend into the body recess or well 30. By so arranging the wire 16*a*, a wire crossing relief is provided whereby all the wires 16*a*, 16*b* and 16*c* may be inserted in cross-over disposition with each wire fully seated on the bottom wall 26*c* of its respective slot. As such, the maximum insertion of each wire may be achieved as can be seen in FIG. 5 wherein the last inserted wire 16*c* rests on slot bottom wall 26*c* despite the intersection with the other wires.

In forming the wire termination assembly 34 as described herein, a good electrical connection is achieved as a result of the intimate contact along the length of the wire 16 within the slot 26. For example, for receipt of 30 gauge wire (approximately 0.010 inch conductor diameter) the slot width w may be formed to be about 0.006 inch at the bottom and 0.012 at the top, while the diameter of body 18 may be about 0.070 inch. Accordingly, the length of the slot 26, being somewhat greater than the diameter of contact body 18, is here more than seven times the slot width. While such a ratio of slot length to width is desirable, the term "substantially greater than" as used hereinabove is intended to at least mean that this ratio is no less than two or three. Also, to ensure sufficient insulation removal and conductor wiping action, the depth of the slot at the central portion of the body, i.e., at the deepest portion of the slot, is at least several times greater than the width of the slot. Contacts 0.070 inch in diameter are suitable for placement on a 0.10 inch (100 mil) grid on board 12. By suitable proportionate scaling down of dimensions of the contact and slots and use of wire finer than 30 gauge, contacts can be placed on a 50 mil grid. It will be appreciated by those skilled in the art that this represents an important increase in wiring density compared to prior systems.

Wires 16*a*, 16*b* and 16*c* have been shown with each coming in and going out from body 18 without being cut. This is equivalent to six wire-wrap terminations. As each wire termination in the present assembly is equivalent to two wire-wraps, the reliability is increased thereover. Thus the present system makes it very easy to daisy-chain or series-wire contacts for power distribution, for example. However, it should be appreciated that each wire may easily be cut within the contact body in the vicinity of recess 30. This is accomplished by putting a barb or chisel edge on the tool stuffer blade which cuts the wire against a slot edge 30*b*, for example.

Figure 8:
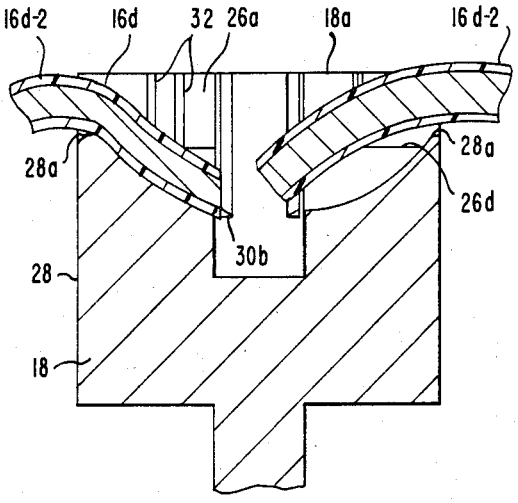
FIG. 8 is an enlarged view similar to FIG. 6 but showing how a wire can be cut in the center of a terminal.

FIG. 8 is a cross-section of contact body 18 showing a wire 16*d*, the left-hand portion of which has been stuffed in a slot 26 and cut at edge 30*b*. The right-hand portion of wire 16*d* has not been stuffed and can easily be removed and discarded. In similar fashion another wire can be stuffed in the right-hand part of the slot without disturbing the already stuffed left-hand wire. Thus, up to six separate wires may be terminated in contact body 18 while maintaining the contact integrity of each wire. Ribs 32 and shoulder 26*d* are also shown in FIG. 8.

In order to avoid creating a stress point or locus of failure of the wire where it enters a slot in terminal 14, the wire and its insulation are gently yet firmly held where they enter the slot. To this end, as seen in FIG. 8, the periphery or outer edge 28 of a contact body 18 is rounded at lip 28*a*, and, of course, the slot is wider at the top than at the bottom. Thus, the wire is not subjected to a sharp or knife-edge surface, contrary to the "quick-connect" system described hereinabove. In the present arrangement the wire conductor is progressively stressed and deformed from somewhat below lip 28*a* to the center of the terminal 14. Electrical contact to the wire is made deep inside the slot and is thereby protected from mechanical disturbance by a hairpin-like loop in the slot and its complex shape.

It is extremely important in an interconnection system of the kind being described that an easily followed and reliable wiring change procedure be available. Here, because up to six separate wires can be terminated in a single contact body, one or several slots may be left unused and available for future changes. The availability of a factory-fresh slot obviates the removal of existing wire terminations and, most importantly, means that the addition of a new wire does not disturb any wire already terminated.

This wiring system described herein accommodates a range of wire insulation types not readily usable with prior systems. Thus, the insulation on wire 16 can adhere to the conductor, as in the case of "Formvar" insulated wire, or it can be an insulation such as Teflon (Du Pont trademark) coating which is difficult to strip from fine wires. The very powerful and extended skiving action which takes place when a wire 16 is stuffed into a slot 26 insures that almost any kind of insulation will be removed in the contact areas. Indeed, side portions of the wire conductor itself are scraped clean in the crimping operation leaving virgin copper wedged against wiped-clean walls of the slot.

As mentioned earlier, it is important for a wire when being terminated to be accurately positioned relative to a slot, otherwise the wire may be broken or guillotined. The top surface 18*a* of a terminal 14 as seen in FIG. 2 may be likened to the face of a clock, with radial slots 26 at 1 o'clock, 3, 5, 7, 9 and 11. Visualizing that a wire is held parallel to face 18*a* and is being brought down to it, it is necessary to laterally align the wire and to angularly (i.e., radially) orient it so that it comes to rest along and properly in the top of a slot 26. This is accomplished as follows.

Figure 9:
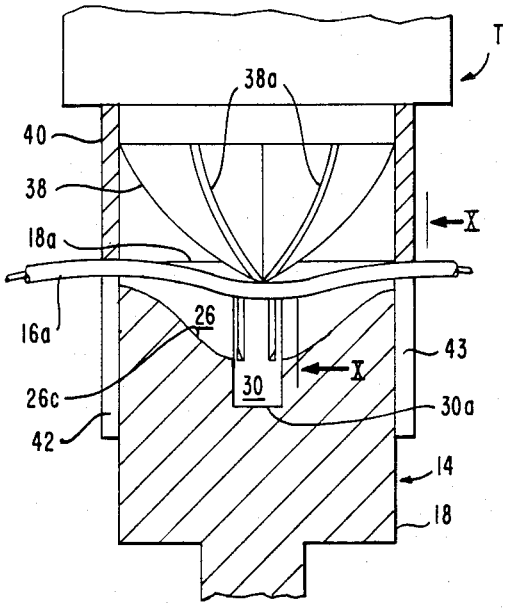
FIG. 9 is a cross-sectional view similar to FIG. 5 but showing a tool for indexing and aligning a wire relative to a terminal.

FIG. 9 shows a cross-section of a terminal 14 with wire 16*a*, the first wire to be terminated, lying along the top mouth of a slot 26, for instance, the slot at one and seven o'clock in FIG. 2. Applicator tool T is located laterally relative to contact body 18 by means of a thin-walled cup or skirt 40 which slidably fits over the top and around the circumference of contact body 18. Wire 16*a* is stretched between diametrically opposite slots 42 and 43 in cup 40 and is held in the position shown relative to the cup 40 as the tool is vertically indexed on a terminal 14. Lying above wire 16*a* within cup 40 is a stuffer blade 38 (see also FIG. 7) which is free to slide downwardly, but not rotate, relative to cup 40 when the tool is actuated to crimp wire 16*a* into slot 26. The stuffer blade is precisely aligned above and along the wire by cup slots 42 and 43. The blade has radial splines or vanes 38*a* which precisely fit (with suitable clearance) the slots at 1, 3, 5, 7, 9 and 11 o'clock. The blade vanes have curved bottoms to substantially conform to the bottom curvature of the slots 26.

Now, while wire 16*a* is laterally and vertically aligned with respect to terminal 14 by tool cup 40, the radial alignment may not be correct. But this is precisely achieved, once lateral and vertical alignment are present, by lightly pushing down on blade 38 and simultaneously or sequentially slightly rotating tool T. During this rotative operation, cup 40 is held approximately in the vertical position shown in FIG. 9 by wire 16*a* which is bottomed in cup slots 42 and 43 and which rests on the upper face 18*a* of the terminal. As the tool is rotated whatever slight amount is necessary, wire 16*a* indexes itself and tool blade splines 38*a* into precise radial alignment with the slots 26. This positions wire 16*a* as shown in FIG. 9 and in enlarged detail in FIG. 10.

Cup 40 and blade 38 are free to rotate together, with a controlled frictional force, relative to the body of tool T. Thus, while wire 16*a* is held against face 18*a* but not indexed in a slot, rotation of the body of tool T rotates cup 40, and with it wire 16*a* into indexed position relative to a desired slot 26. An increased light, downward force by the tool will now insure that further rotation of the tool body in either direction will thereafter not move the wire out of indexed relation to the slot, as the frictional force applied to rotate cup 40 is insufficient to dislodge wire 16*a* from the slot mouth where it is held by blade 38, the wire thereby preventing the cup from rotating. Since the stuffer blade, because of the positioning of cup slots 42 and 43, is precisely aligned relative to wire 16*a* and with all the slots 26 in terminal 14, the tool blade may now be moved forcefully downward to push the wire all the way into its respective slot. Near the end of its stroke, a spring (not shown) within the tool is released to cause the stuffer blade to give a sudden, sharp blow to the wire thereby coining the wire tightly into wedged condition in the slot. A much more complete description of tool T is given in the copending patent application mentioned hereinabove.

Figure 10:
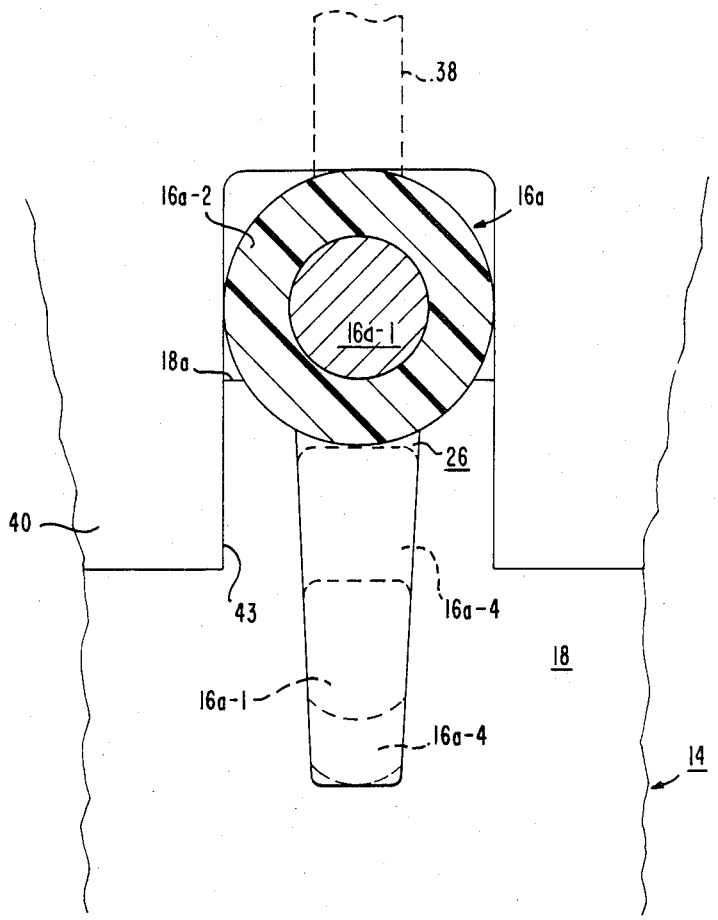
FIG. 10 is an enlarged view, partly in cross-section, as seen along viewing lines X—X of FIG. 9 and illustrating a wire before and after termination.

FIG. 10 shows in cross-section the position of wire 16*a* when seated in the mouth of slot 26 by blade 38 prior to stuffing. Also shown is slot 43 of tool cup 40 which with slot 42 (shown only in FIG. 9) is bottomed on the top of wire 16*a* and which holds the cup 40 radially aligned on the terminal 14 as explained above. Here in FIG. 10 the insulation 16*a*-4 on wire 16*a* has a wall thickness about half the diameter of the wire conductor 16*a*-1. This, in comparison to FIG. 7 where insulation 16*a*-2 is only about one-twentieth the conductor diameter, illustrates the wide range of insulation thicknesses usable with terminal 14 for a given wire gauge. Of course, for smaller diameter wires, slots 42 and 43 should be narrower.

Shown in FIG. 10, in dotted outline near the bottom of slot 26, is the coined conductor 16*a*-1 of the wire after stuffing, portions of the insulation 16*a*-4 being tightly compacted between the bottom of the conductor 16*a*-1 and the bottom of the slot 26. It will be noted that the conductor is substantially deformed from its original circular condition, and is wedged tightly along its sides in the slot. The insulation remaining above and below the conductor, even though sizable in volume, does not interfere with the mechanical and electrical integrity of the termination. Even though the wire insulation between the bottom of the conductor and the bottom of the slot is relatively soft compared to the metal of the wire and terminal, the stuffing action of the tool and the final sharp blow to the conductor by tool blade 38 causes the substantial deformation of the conductor as shown, and results in a gas-tight electrical joint.

Use of the terminals 14 described herein in the wire termination system accordingly allows for a low profile interconnection and excellent impedance matching. The provision of separate slots for the wires allows each of the wires to lie substantially the same close distance from the circuit board thereby virtually eliminating impedance mismatching problems. Further, the provision of separate slots allows subsequent connections to be made without substantially interfering with previously made connections. The use of plural slots in a terminal not only permits the separate connections as set forth herein but provides for ready repair inasmuch as one slot may be left empty as a "spare" for later use. Moreover, the contacts may be mounted for high-density interconnections on centers of 0.050 inch or less.

Having described the preferred form of the invention herein, it should be appreciated that various modifications may be made without departing from the intended scope thereof. The particularly disclosed and depicted embodiments of the invention and methods are thus intended in an illustrative rather than limiting sense. The true scope of the invention is set forth in the following claims.

I claim:

1. A method of reliably terminating fine insulated wires on very close centers comprising: providing a plurality of contact devices having upper faces each with a plurality of radially extending wire receiving slots, indexing a wire relative to the end of a stuffing tool, indexing the tool laterally on a contact device and vertically thereagainst with the wire lying across the upper face of the device, radially indexing the wire relative to a selected slot to seat the wire in the top of the slot, progressively forcing the wire into the slot deeper near the center of the device than at the outer edge, the wire being inserted sufficiently deep near the center to skive away the insulation along the sides of the wire conductor, and forcibly seating the wire with a portion of the wire insulation tightly compacted between the bottom of the wire conductor and a bottom wall of the slot, the wire conductor being substantially deformed and wedged tightly in the slot.

2. A method according to claim 1, further including the step of cutting said wire within a contact device.

3. A method according to claim 2, wherein said wire cutting is effected by said stuffing tool whereby during forcing of said wire into said slot said wire is severed.

4. A method according to claim 1, wherein a plurality of wires are forced into said slots in cross-over disposition such that at the intersection thereof said wires are provided with a cross-over relief.

5. A method according to claim 4, wherein said cross-over relief is effected by providing a recess in the contact device at the location of the intersection of the wires, said recess being deeper than said slots and within which recess portions of said wires are received.

6. A method according to claim 1, wherein the wire is formed into a hairpin-like loop within the contact device and extends radially into one side and out from the other side of the device whereby improved electrical and mechanical performance is achieved.

* * * * *